US010395873B1

(12) United States Patent
Eberts et al.

(10) Patent No.: US 10,395,873 B1
(45) Date of Patent: Aug. 27, 2019

(54) CIRCUIT BREAKER, FASTENING ASSEMBLY THEREFOR, AND ASSOCIATED ASSEMBLY METHOD

(71) Applicant: EATON INTELLIGENT POWER LIMITED, Dublin (IE)

(72) Inventors: William George Eberts, Moon Township, PA (US); Jordan C. Myers, Bethel Park, PA (US); Kimberley A. Silken, Richfield, MN (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/948,492

(22) Filed: Apr. 9, 2018

(51) Int. Cl.
*H01H 69/01* (2006.01)
*H01H 71/14* (2006.01)
*H01H 71/16* (2006.01)
*H01H 71/02* (2006.01)

(52) U.S. Cl.
CPC ..... *H01H 71/164* (2013.01); *H01H 69/01* (2013.01); *H01H 71/0207* (2013.01)

(58) Field of Classification Search
CPC ... H01H 71/164; H01H 69/01; H01H 71/0207
USPC ..... 337/107
See application file for complete search history.

(56) References Cited

U.S. PATENT DOCUMENTS 2,122,693 A * 7/1938 Maseng ..... H01H 71/16 337/111
2,199,388 A * 5/1940 Bolesky ..... H01H 61/002 29/522.1
2,199,638 A * 5/1940 Lee ..... H01H 37/54 337/102
2,214,626 A * 9/1940 Pierce ..... H01H 71/164 337/107
2,459,588 A * 1/1949 Sandin ..... H01H 71/44 335/23
2,897,319 A * 7/1959 Wolff ..... H01H 71/10 337/102
2,922,008 A * 1/1960 Hill ..... H01H 71/162 337/101
3,116,388 A * 12/1963 Hobson, Jr. ..... H01H 83/20 335/173
3,155,795 A * 11/1964 Jencks ..... H01H 71/162 337/101
3,162,739 A * 12/1964 Klein ..... H01H 71/162 335/35
3,258,560 A * 6/1966 Jencks ..... H01H 71/40 335/173
3,417,358 A * 12/1968 Di Marco ..... H01H 71/162 337/100
3,852,694 A * 12/1974 Di Marco ..... H01H 71/04 337/102

(Continued)

*Primary Examiner* — Anatoly Vortman
(74) *Attorney, Agent, or Firm* — Eckert Seamans Cherin & Mellott, LLC

(57) ABSTRACT

A fastening assembly is for a circuit breaker. The circuit breaker has a base and a bimetal. The fastening assembly includes a heater element structured to be coupled to the bimetal and the base, and a plurality of fastening members including a nut and a coupling member coupled to the nut. The nut is structured to be disposed between the heater element and the bimetal. The coupling member extends through the heater element and into the nut in order to minimize movement of the heater element with respect to the base.

18 Claims, 5 Drawing Sheets

(56) References Cited

U.S. PATENT DOCUMENTS

| | | | | | |
|---|---|---|---|---|---|
| 3,903,493 | A * | 9/1975 | Richards | H01H 71/7427 | 335/42 |
| 4,047,141 | A * | 9/1977 | Holden | H01H 37/54 | 337/89 |
| 4,458,225 | A * | 7/1984 | Forsell | H01H 71/40 | 218/117 |
| 4,630,019 | A * | 12/1986 | Maier | H01H 71/7436 | 335/45 |
| 4,885,560 | A * | 12/1989 | Niino | H01H 37/002 | 337/3 |
| 5,235,308 | A * | 8/1993 | Shimada | H01H 37/002 | 337/102 |
| 5,793,026 | A * | 8/1998 | Kolberg | H01H 71/7463 | 335/172 |
| 6,225,882 | B1 * | 5/2001 | Hood | H01H 71/0214 | 335/172 |
| 6,373,357 | B1 * | 4/2002 | Douville | H01H 77/02 | 218/154 |
| 7,518,482 | B2 * | 4/2009 | Fleege | H01H 71/16 | 337/36 |
| 7,800,478 | B2 * | 9/2010 | Puhalla | H01H 71/0207 | 335/145 |
| 9,378,916 | B2 * | 6/2016 | Turner | H01H 71/164 | |
| 9,633,809 | B2 * | 4/2017 | Oh | H01H 37/64 | |
| 9,779,900 | B2 * | 10/2017 | Thomas | H01H 71/164 | |

* cited by examiner

CIRCUIT BREAKER, FASTENING ASSEMBLY THEREFOR, AND ASSOCIATED ASSEMBLY METHOD

BACKGROUND

Field

The disclosed concept relates generally to electrical switching apparatus and, more particularly, to electrical switching apparatus, such as for example, circuit breakers. The disclosed concept also relates to fastening assemblies and assembly methods for circuit breakers.

Background Information

Electrical switching apparatus, such as molded case circuit breakers, generally include at least one pair of separable contacts which are operated either manually, by way of a handle disposed on the outside of the circuit breaker housing, or automatically by way of a trip unit in response to a trip condition (e.g., without limitation, an overcurrent condition; a relatively high level short circuit or fault condition; a ground fault or arc fault condition).

FIG. 1 shows an example of a molded case circuit breaker 2 having a molded case housing 4 and employing a thermal trip assembly 6. The thermal trip assembly 6 includes a bimetal 8 and a heater element 10 (e.g., load conductor). Even small movements of the heater element 10 can result in significantly amplified movement of the bimetal, resulting in inaccurate calibration. In an effort to resist undesired movement and thereby improve calibration, epoxy 12 (shown in exaggerated enlarged form in FIG. 1 for purposes of illustration) has been used to secure the heater element 10 to the circuit breaker housing 4. In the example of FIG. 1, a shim 14 is included between the housing 4 and heater element 10. Among other problems, occasionally the epoxy 12 fails to hold, for example, due to grease or other contamination on the surface of one or more of the circuit breaker components. Additionally, tests show that relatively substantial undesirable movement (e.g., in the direction of arrow 16 in FIG. 1) can still occur even with the epoxy 12 in place holding the heater element 10 to the housing 4.

There is room for improvement in circuit breakers, fastening assemblies therefor, and associated assembly methods.

SUMMARY

These needs and others are met by embodiments of the invention, which are directed to a circuit breaker, fastening assembly therefor, and associated assembly method.

As one aspect of the disclosed concept, a fastening assembly is provided for a circuit breaker. The circuit breaker has a base and a bimetal. The fastening assembly includes a heater element structured to be coupled to the bimetal and the base, and a plurality of fastening members including a nut and a coupling member coupled to the nut. The nut is structured to be located between the heater element and the bimetal. The coupling member extends through the heater element and into the nut in order to minimize movement of the heater element with respect to the base.

As another aspect of the disclosed concept, a circuit breaker including a base, a bimetal, and the aforementioned fastening assembly is provided.

As another aspect of the disclosed concept, a method of assembling a circuit breaker is provided. The method includes the steps of providing the circuit breaker with a base, a bimetal, and a fastening assembly, the fastening assembly having a heater element coupled to the bimetal and the base, and a plurality of fastening members including a nut and a coupling member; disposing the nut between the heater element and the bimetal; and extending the coupling member through the heater element and into the nut in order to minimize movement of the heater element with respect to the base.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
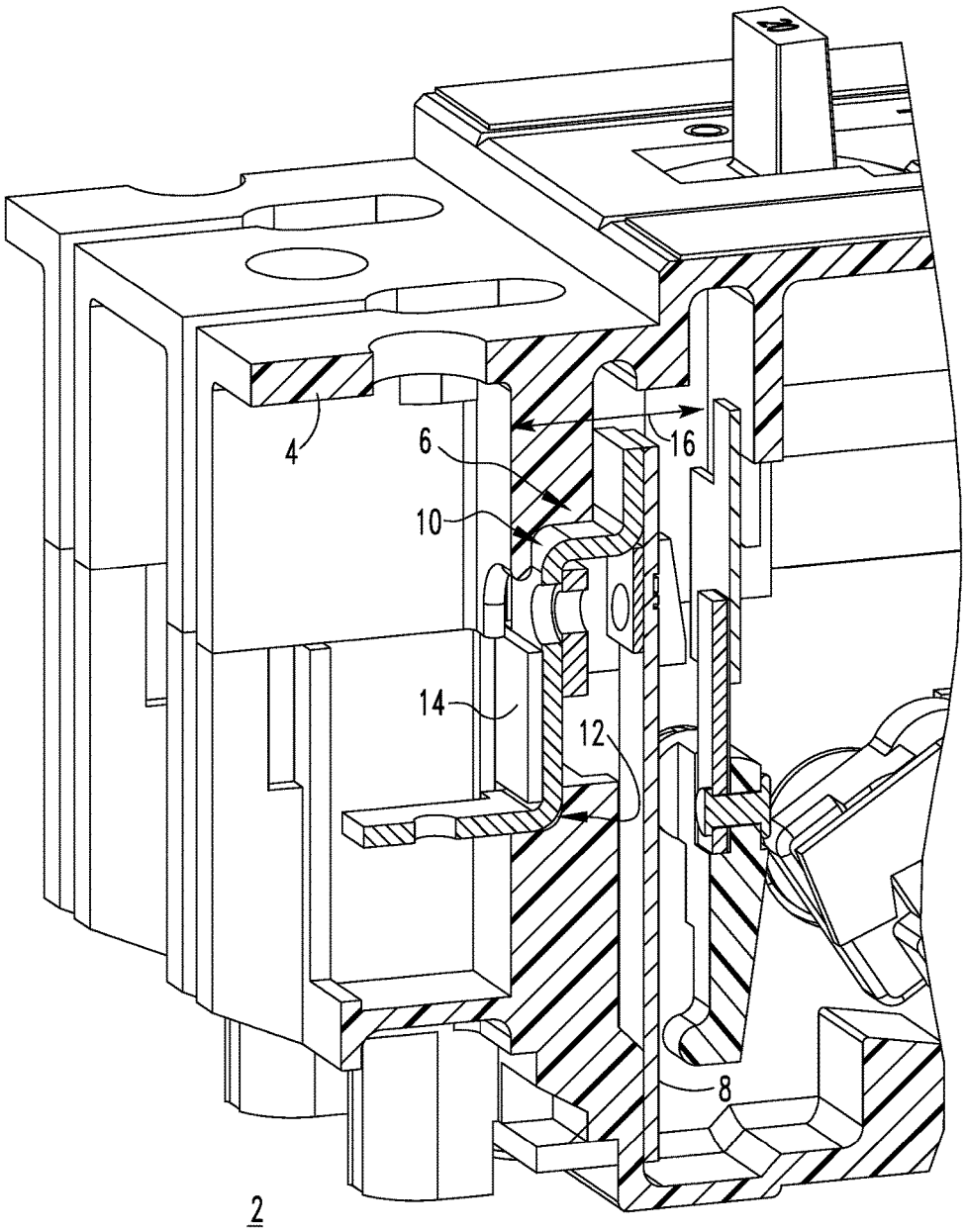
FIG.1 PRIOR ART
FIG. 1 is an isometric view of a portion of a known circuit breaker and heater assembly.

As employed herein, the singular form of "a", "an", and "the" include plural references unless the context clearly dictates otherwise. Still further, as used herein, the term "number" shall mean one or an integer greater than one (e.g., a plurality).

As employed herein, the term "coupled" shall mean that two or more parts are joined together directly or joined through one or more intermediate parts. Furthermore, as employed herein, the phrase "directly connected" shall mean that two or more parts are joined together directly, without any intermediate parts being disposed therebetween at the point or location of the connection.

As employed herein, the term "coupling member" refers to any suitable connecting or tightening mechanism expressly including, but not limited to, screws, bolts and the combinations of bolts and nuts (e.g., without limitation, lock nuts) and bolts, washers and nuts.

FIGS. 2-5 show an electrical switching apparatus, such as for example and without limitation, a circuit breaker 102, in accordance with one non-limiting embodiment of the disclosed concept. The circuit breaker 102 includes a molded base 103, a bimetal 106, and a novel fastening assembly 110. The fastening assembly 110 includes a heater element 122 (e.g., load conductor) and a plurality of fastening members (e.g., without limitation, a nut 132, a coupling member (e.g., without limitation, screw 152), and a plate member 162). As will be discussed in greater detail below, the fastening assembly 110 provides a novel mechanism to substantially minimize and/or eliminate movement of the heater element 122 with respect to the base 103.

Figure 2:
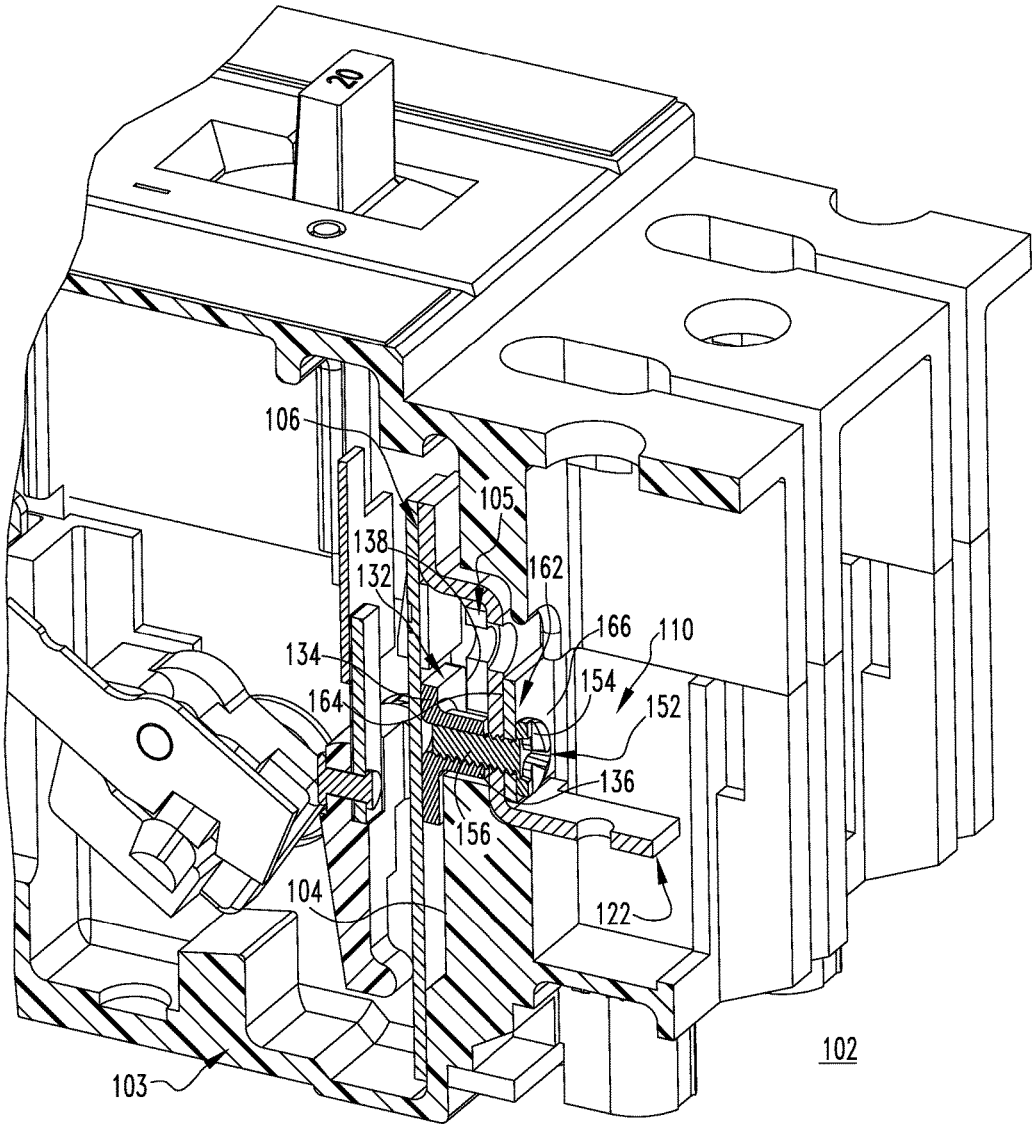
FIG. 2 is an isometric partially in section view of a portion of a circuit breaker and fastening assembly therefor, in accordance with a non-limiting embodiment of the disclosed concept.

As shown, the nut 132 is preferably located between the heater element 122 and the bimetal 106. Referring to FIG. 2, the screw 152 has a head portion 154 and a threaded portion 156 extending from the head portion 154. The heater element 122 is located between the head portion 154 and the nut 132. The threaded portion 156 extends through the heater element 122 and into the nut 132 in order to minimize and/or eliminate movement of the heater element 122 with respect to the base 103. See, for example, portion 105 of base 103. The nut 132 has a stabilizing portion 134 and a post portion 136 extending outwardly from the stabilizing portion 134 and away from the bimetal 106. The stabilizing portion 134 is located substantially perpendicular to the post portion 136.

Figure 3:
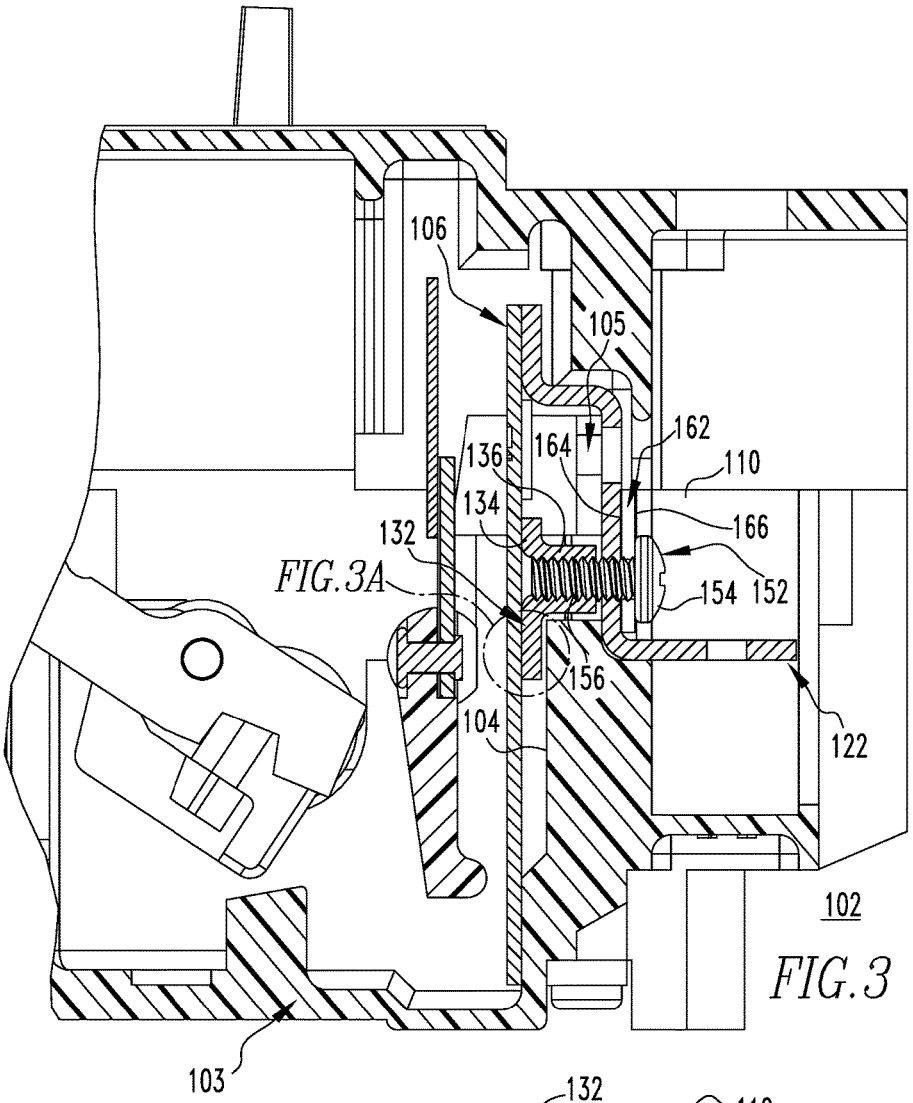
FIG. 3 is a side elevation partially in section view of the circuit breaker and fastening assembly therefor of FIG. 2.
Figure 3A:
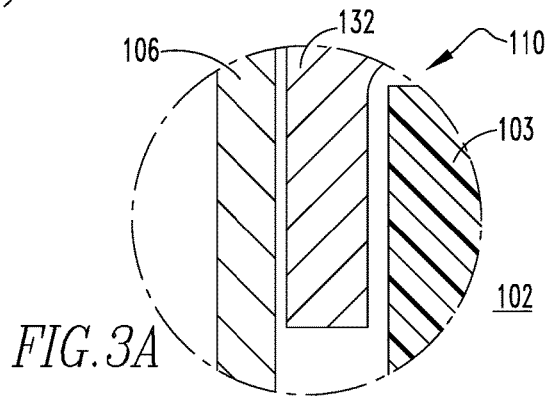
FIG. 3A is an enlarged view of a portion of the circuit breaker and fastening assembly therefor of FIG. 3.

Referring to FIG. 3, the base 103 has a surface 104 facing and being located parallel to the bimetal 106. Furthermore, the stabilizing portion 134 of the nut 132 is substantially located between the surface 104 and the bimetal 106, and is located parallel to the bimetal 106. By fitting in this pocket between the surface 104 and the bimetal 106, the stabilizing portion 134 advantageously allows the screw 152 to be tightened into the nut 132, and thus allows the heater element 122 to be retained on the base 103. Furthermore, as shown in FIG. 3A, in one example embodiment the nut 132 is spaced from the bimetal 106. As a result, the nut 132 does not throw off the calibration and/or disturb tripping times. Specifically, the current path is from the beginning of the heater element 122 through the entire length of the bimetal 106, and then through the rest of the circuit breaker 102. If the nut 132 were to touch the bimetal 106, some current would not go through half of the heater element 122 and half of the bimetal 106. Accordingly, the disclosed configuration wherein the nut 132 is spaced from the bimetal 106 is particularly advantageous.

Figure 4:
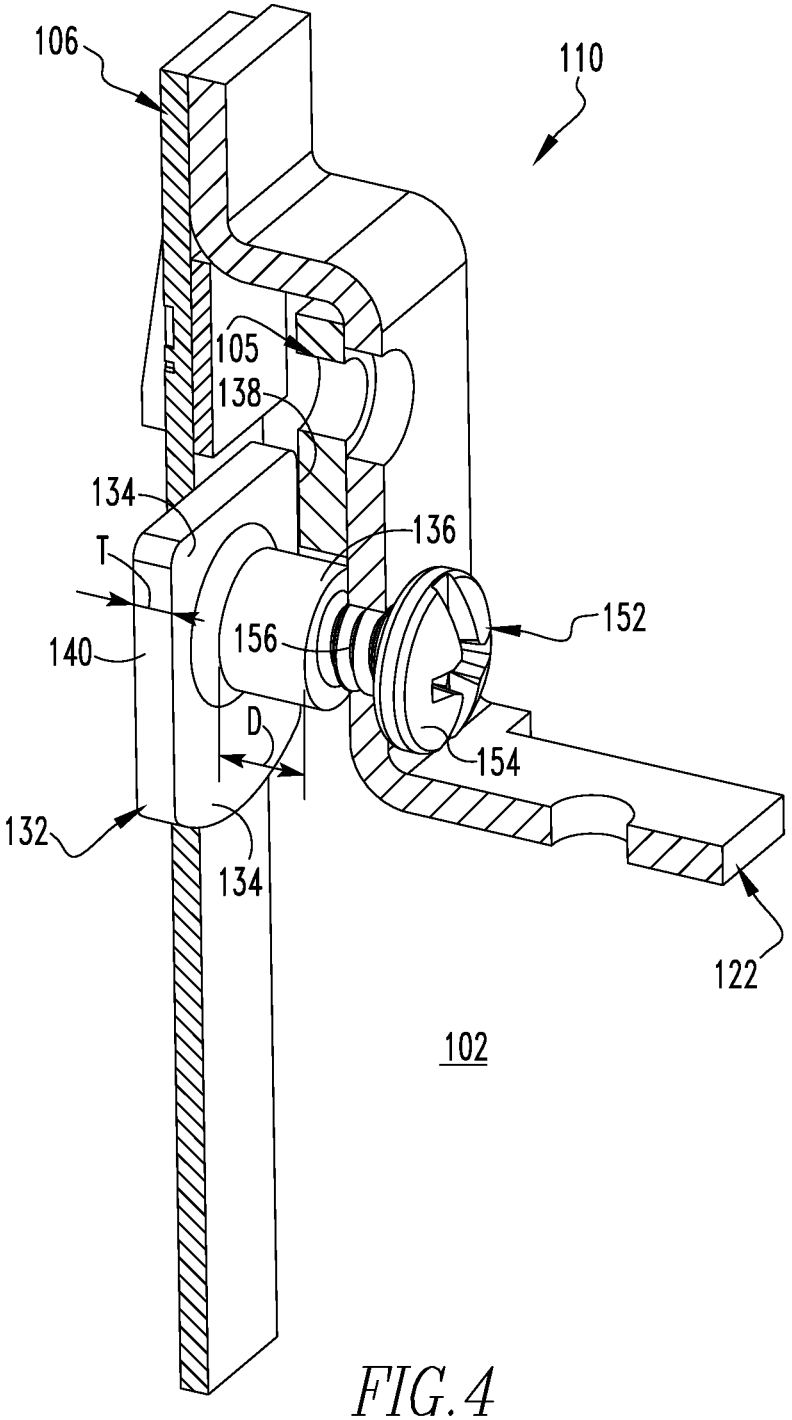
FIGS. 4 and 5 are different isometric partially in section views of portions of the circuit breaker and fastening assembly therefor of FIG. 2, shown without a plate member.

Referring to FIG. 4, the stabilizing portion 134 includes a first edge portion 138 and a second edge portion 140 located opposite and substantially parallel to the first edge portion 138. While the circuit breaker 102 is being assembled, the first and second edge portions 138,140 are structured to engage the base 103 in order to allow the screw 152 to couple to the nut 132. Accordingly, it will be appreciated that the stabilizing portion 134 is structured to engage the base 103 in order to prevent the nut 132 from rotating with respect to the base 103. While the disclosed concept has been described thus far in association with the stabilizing portion 134 and associated first and second edge portions 138,140 being employed to perform the desired function of preventing rotation of the nut 132 during tightening of the screw 152, it will be appreciated that suitable alternative methods and/or geometries of components may be employed, without departing from the scope of the disclosed concept. For example and without limitation, it is within the scope of the disclosed to provide an alternative nut (not shown) together with a molded base that has a protrusion and/or stopper member (not shown) that inhibits rotation of the nut during tightening of a screw.

Continuing to refer to FIG. 4, as shown, the post portion 136 extends from the stabilizing portion 134 a distance D, and the stabilizing portion 134 has a thickness T. In one example embodiment, the distance D is at least 2.5 times the thickness T. It will thus be appreciated that the nut 132 provides ample surface area over which the threaded portion 156 of the screw 152 can be threadably engaged with the nut 132. However, it is to be understood that this ratio is not limiting on the scope of the disclosed concept, and that suitable alternative ratios (e.g., less than 2.5) are contemplated herein.

Referring again to FIG. 3, the example plate member 162 is depicted. In one example embodiment, the plate member 162 is located substantially parallel to the bimetal 106 and the stabilizing portion 134 of the nut 132, and is located perpendicular to the post portion 136 of the nut 132. As shown, the plate member 162 has a first surface 164 and a second surface 166 opposite and parallel to the first surface 164. The first surface 164 engages and is substantially flush with the heater element 122. The second surface 166 engages the head portion 154 of the screw 152. Accordingly, it will be appreciated that the plate member 162 advantageously provides a mechanism to distribute load from the head portion 154 of the screw 152 over a relatively large surface area of the heater element 122, rather than a localized region. As such, the plate member 162 may improve the ability of the screw 152 to secure the heater element 122 to the base 103. It will, however, be appreciated that fastening assemblies in accordance with the disclosed concept may be employed without plate members. That is, suitable alternative fastening assemblies (not shown), may instead have head portions of screws, or other alternative coupling members, be directly engaged with heater elements, instead of plate members, without departing from the scope of the disclosed concept.

Figure 5:
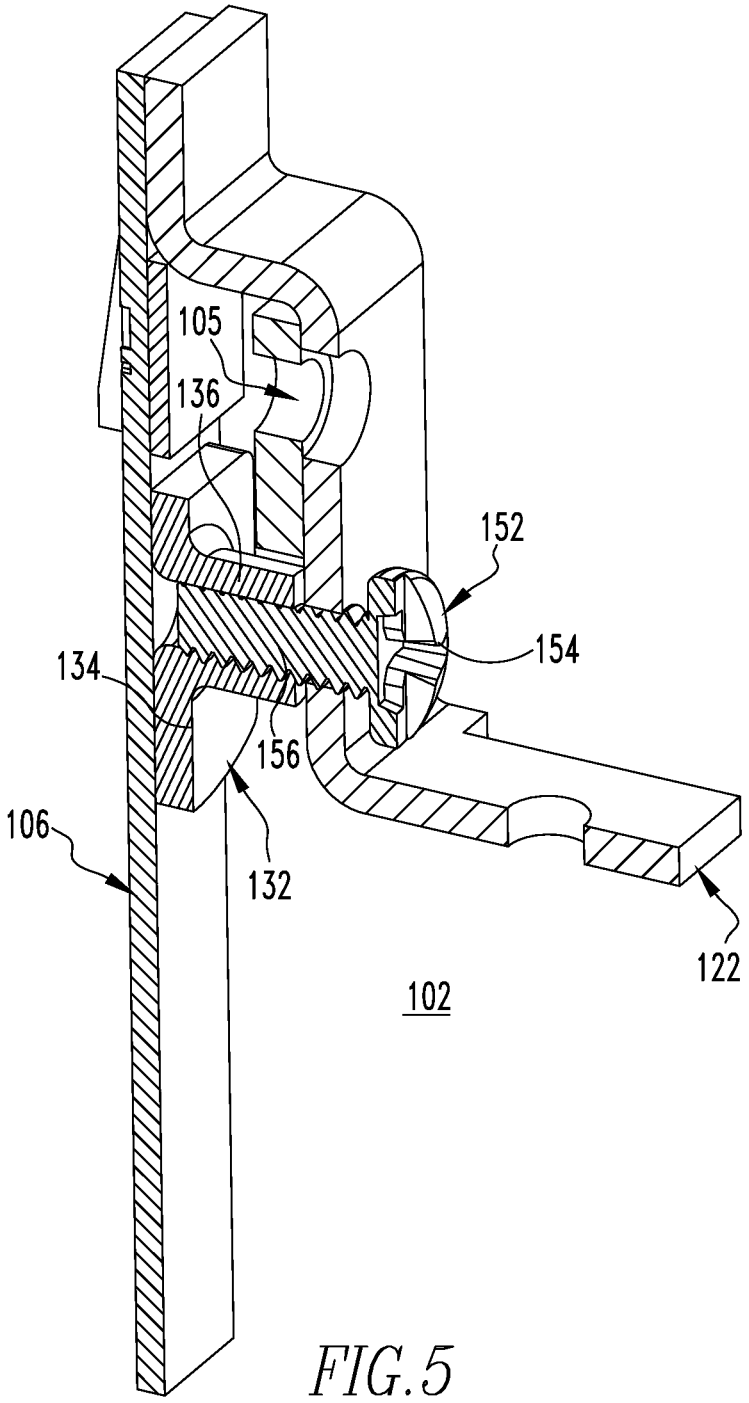

As discussed above, the novel fastening assembly 110 substantially minimizes and/or eliminates movement of the heater element 122 with respect to the base 103. Referring to FIG. 5, the heater element 122 is located between the head portion 154 of the screw 152 and the nut 132. Additionally, although only partially shown in FIG. 5, the portion 105 of the base 103 is located on a side of the heater element 122 opposite the head portion 154 of the screw 152. As such, it will be appreciated that when the screw 152 is tightened into the nut 132, the heater element 122 is pulled into the portion 105 of the base 103. This secure and novel connection advantageously allows the heater element 122 to be substantially retained in a predetermined position. Stated differently, there is a significantly reduced likelihood that the heater element 122 will move during the life of the circuit breaker 102, as a result of the novel fastening assembly 110. It follows that the bimetal 106, which is coupled to the heater element 122, will likewise be substantially retained in place during the life of the circuit breaker 102. Thus, calibration of the circuit breaker 102 is improved, as compared to the prior art circuit breaker 2, shown in FIG. 1 and discussed above. In one example embodiment, the circuit breaker 102 in accordance with the disclosed concept is entirely devoid of epoxy engaging and holding the heater element 122, distinct from prior art circuit breakers (e.g., circuit breaker 2, shown in FIG. 1) which typically require epoxy to hold and maintain heater elements to the base. Additionally, it is also within the scope of the disclosed concept to provide a glue like material between the nut 132 and the screw 152 in order to prevent the screw 152 from loosening over time.

It will be appreciated that a method of assembling the circuit breaker 102 includes the steps of providing the circuit breaker 102 with a base 103, a bimetal 106, and a fastening assembly 110, the fastening assembly 110 having a heater element 122 coupled to the bimetal 106 and the base 103, and a plurality of fastening members including a nut 132 and a coupling member (e.g., screw 152); disposing the nut 132 between the heater element 122 and the bimetal 106; and extending the screw 152 through the heater element 122 and into the nut 132 in order to minimize movement of the heater element 122 with respect to the base 103. The method may also include the step of screwing the screw 152 into the nut 132, the nut 132 engaging the base 103 during the screwing step in order to prevent rotation of the nut 132.

Accordingly, it will be appreciated that the disclosed concept provides for an improved (e.g., without limitation, better secured heater element 122 and bimetal 106, more accurately calibrated circuit breaker 102) circuit breaker 102, fastening assembly 110 therefor, and associated assembly method in which a coupling member 152 extends through the heater element 122 and into a nut 132 in order to minimize movement of the heater element 122 with respect to the base 103.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

The invention claimed is:

1. A fastening assembly for a circuit breaker, said circuit breaker comprising a base and a bimetal, said fastening assembly comprising:

a heater element coupled to said bimetal and said base; and a plurality of fastening members comprising a nut and a coupling member coupled to said nut, said nut being disposed between said heater element and said bimetal, said coupling member extending through said heater element and into said nut in order to minimize movement of said heater element with respect to said base, wherein said nut comprises a stabilizing portion and a post portion extending outwardly from said stabilizing portion and away from said bimetal.

2. The fastening assembly of claim 1 wherein said stabilizing portion is disposed substantially perpendicular to said post portion.

3. The fastening assembly of claim 1 wherein said stabilizing portion comprises a first edge portion and a second edge portion disposed opposite and substantially parallel to said first edge portion; and wherein each of said first edge portion and said second edge portion engages said base in order to allow said coupling member to couple to said nut.

4. The fastening assembly of claim 1 wherein said stabilizing portion is disposed substantially parallel to said bimetal.

5. The fastening assembly of claim 1 wherein said post portion extends from said stabilizing portion a distance; wherein said stabilizing portion has a thickness; and wherein the distance is at least 2.5 times the thickness.

6. The fastening assembly of claim 1 wherein said fastening assembly is devoid of epoxy engaging said heater element.

7. A fastening assembly for a circuit breaker, said circuit breaker comprising a base and a bimetal, said fastening assembly comprising:

a heater element coupled to said bimetal and said base; and a plurality of fastening members comprising a nut and a coupling member coupled to said nut, said nut being disposed between said heater element and said bimetal, said coupling member extending through said heater element and into said nut in order to minimize movement of said heater element with respect to said base, wherein said coupling member is a screw; wherein said screw comprises a head portion and a threaded portion extending from said head portion; and wherein said heater element is disposed between said head portion and said nut.

8. The fastening assembly of claim 7 wherein said plurality of fastening members further comprises a plate member having a first surface and a second surface opposite and parallel to said first surface; wherein said first surface engages said heater element; and wherein said second surface engages said head portion of said screw.

9. The fastening assembly of claim 8 wherein said plate member is disposed parallel to said bimetal.

10. The fastening assembly of claim 9 wherein said nut comprises a stabilizing portion and a post portion extending outwardly from said stabilizing portion and away from said bimetal; wherein said stabilizing portion is disposed substantially parallel to said plate member; and wherein said post portion is disposed substantially perpendicular to said plate member.

11. A circuit breaker comprising:

a base;

a bimetal; and a fastening assembly comprising:

a heater element coupled to said bimetal and said base, and a plurality of fastening members comprising a nut and a coupling member coupled to said nut, said nut being disposed between said heater element and said bimetal, said coupling member extending through said heater element and into said nut in order to minimize movement of said heater element with respect to said base, wherein said nut comprises a stabilizing portion and a post portion extending outwardly from said stabilizing portion and away from said bimetal; and wherein said stabilizing portion engages said base in order to prevent said nut from rotating with respect to said base.

12. The circuit breaker of claim 11 wherein said base has a surface facing said bimetal and disposed parallel with respect thereto; and wherein said stabilizing portion is disposed between said surface and said bimetal.

13. The circuit breaker of claim 11 wherein said stabilizing portion is disposed substantially perpendicular to said post portion.

14. The circuit breaker of claim 11 wherein said stabilizing portion comprises a first edge portion and a second edge portion disposed opposite and substantially parallel to said first edge portion; and wherein each of said first edge portion and said second edge portion engages said base in order to allow said coupling member to couple to said nut.

15. The circuit breaker of claim 11 wherein said post portion extends from said stabilizing portion a distance; wherein said stabilizing portion has a thickness; and wherein the distance is at least 2.5 times the thickness.

16. A circuit breaker comprising:

a base;

a bimetal; and a fastening assembly comprising:

a heater element coupled to said bimetal and said base, and a plurality of fastening members comprising a nut and a coupling member coupled to said nut, said nut being disposed between said heater element and said bimetal, said coupling member extending through said heater element and into said nut in order to minimize movement of said heater element with respect to said base, wherein said coupling member is a screw; wherein said screw comprises a head portion and a threaded portion extending from said head portion; wherein said heater element is disposed between said head portion and said nut; wherein said plurality of fastening members further comprises a plate member having a first surface and a second surface opposite and parallel to said first surface; wherein said first surface engages said heater element; and wherein said second surface engages said head portion of said screw.

17. A method of assembling a circuit breaker comprising the steps of:

providing said circuit breaker with a base, a bimetal, and a fastening assembly, said fastening assembly comprising a heater element coupled to said bimetal and said base, and a plurality of fastening members comprising a nut and a coupling member;

disposing said nut between said heater element and said bimetal; and extending said coupling member through said heater element and into said nut in order to minimize movement of said heater element with respect to said base, wherein said nut comprises a stabilizing portion and a post portion extending outwardly from said stabilizing portion and away from said bimetal.

18. The method of claim 17 wherein said coupling member is a screw; and wherein the method further comprises the step of:

screwing said screw into said nut, said nut engaging said base during the screwing step in order to prevent rotation of said nut.

* * * * *